US008887352B2

(12) United States Patent
Muhlenkamp

(10) Patent No.: US 8,887,352 B2
(45) Date of Patent: Nov. 18, 2014

(54) CANISTER VACUUM CLEANER INCORPORATING A CONTROL HANDLE AND NOZZLE ASSEMBLY WITH UPRIGHT SWIVEL LOCK

(75) Inventor: Eric Muhlenkamp, Lexington, KY (US)

(73) Assignee: Panasonic Corporation of North America, Secaucus, NY (US)

( * ) Notice: Subject to any disclaimer, the term of this patent is extended or adjusted under 35 U.S.C. 154(b) by 887 days.

(21) Appl. No.: 13/035,507

(22) Filed: Feb. 25, 2011

(65) Prior Publication Data

US 2012/0216364 A1 Aug. 30, 2012

(51) Int. Cl.

| | |
|---|---|
| ***A47L 9/00*** | (2006.01) |
| ***A47L 9/24*** | (2006.01) |
| ***A47L 5/36*** | (2006.01) |

(52) U.S. Cl.

CPC ... *A47L 5/36* (2013.01); *A47L 9/24* (2013.01); *A47L 9/0054* (2013.01)

USPC ..... 15/411; 15/410

(58) Field of Classification Search

USPC ..... 15/351, 410, 411, 327.1

See application file for complete search history.

(56) References Cited

U.S. PATENT DOCUMENTS

| | | | | | |
|---|---|---|---|---|---|
| 2,074,042 | A | * | 3/1937 | Bank | 285/7 |
| 2,525,283 | A | * | 10/1950 | Brace | 15/410 |
| 2,542,120 | A | | 2/1951 | Coss | |
| 3,291,540 | A | | 12/1966 | Doersam | |
| 4,423,534 | A | * | 1/1984 | Lyman et al. | 15/410 |
| 4,700,429 | A | * | 10/1987 | Martin et al. | 15/377 |
| 5,063,634 | A | | 11/1991 | Hafele et al. | |
| 5,551,120 | A | * | 9/1996 | Cipolla et al. | 15/333 |
| 5,584,095 | A | | 12/1996 | Redding | |
| 6,006,401 | A | * | 12/1999 | Jailor et al. | 15/361 |
| 6,055,703 | A | * | 5/2000 | Redding et al. | 15/411 |
| 6,345,408 | B1 | * | 2/2002 | Nagai et al. | 15/361 |
| 6,473,934 | B2 | * | 11/2002 | Lijzenga | 15/373 |
| 6,553,613 | B2 | * | 4/2003 | Onishi et al. | 15/351 |
| 6,779,229 | B2 | * | 8/2004 | Lee et al. | 15/329 |
| 7,313,845 | B2 | * | 1/2008 | Nam | 15/339 |
| 7,356,876 | B2 | | 4/2008 | Dant et al. | |
| 7,367,085 | B2 | * | 5/2008 | Bagwell et al. | 15/415.1 |
| 7,503,098 | B2 | * | 3/2009 | Stein | 15/414 |
| 7,594,297 | B2 | | 9/2009 | Choi | |
| 7,607,196 | B2 | | 10/2009 | Li | |
| 8,082,624 | B2 | * | 12/2011 | Myers | 15/411 |
| 8,438,699 | B2 | * | 5/2013 | Dyson et al. | 15/351 |
| 8,468,646 | B2 | * | 6/2013 | Yoo | 15/331 |
| 2006/0080803 | A1 | | 4/2006 | Stein | |
| 2008/0022488 | A1 | * | 1/2008 | Dant et al. | 15/414 |
| 2009/0056058 | A1 | | 3/2009 | Finke et al. | |
| 2009/0241284 | A1 | | 10/2009 | Mayes et al. | |
| 2011/0023262 | A1 | * | 2/2011 | Conrad | 15/361 |
| 2012/0060322 | A1 | * | 3/2012 | Simonelli et al. | 15/411 |

OTHER PUBLICATIONS

Search Report for Great Britain patent application No. GB1202440.2 dated May 30, 2012.

* cited by examiner

*Primary Examiner* — Joseph J Hail
*Assistant Examiner* — Joel Crandall
(74) *Attorney, Agent, or Firm* — King & Schickli, PLLC

(57) ABSTRACT

A floor care apparatus includes a body having a nozzle assembly and a canister assembly. A suction generator and a dirt collection vessel are carried on that body. The floor care apparatus also includes a control handle, a swivel assembly and a swivel lock.

17 Claims, 8 Drawing Sheets

CANISTER VACUUM CLEANER INCORPORATING A CONTROL HANDLE AND NOZZLE ASSEMBLY WITH UPRIGHT SWIVEL LOCK

TECHNICAL FIELD AND INDUSTRIAL APPLICABILITY OF THE INVENTION

This document relates to the cleaning equipment field and, more particularly, to a floor care apparatus in the form of a canister vacuum cleaner incorporating a nozzle assembly and a control handle with swivel action control for better maneuverability and a swivel lock for stability when the control handle is in the storage position.

BACKGROUND OF THE INVENTION

Canister vacuum cleaners have long been known in the art. Generally, a canister vacuum cleaner includes a canister assembly that carries a suction generator and a dirt collection vessel usually in the form of a disposable filter bag or a reusable dirt cup. A canister vacuum cleaner also includes a nozzle assembly having a suction inlet. A rotary agitator is usually provided across the suction inlet to enhance the cleaning efficiency of the vacuum cleaner. A control handle, including a wand and flexible hose, connects the nozzle assembly with the canister assembly. Accordingly, during operation the suction generator draws dirt and debris loosened by the rotary agitator through the suction inlet in the nozzle assembly and then through the wand and flexible hose of the control handle into the dirt collection vessel in the canister assembly. There dirt and debris are captured while a relatively clean air stream is drawn from the dirt collection vessel through the motor of the suction generator to provide cooling before being exhausted back into the environment.

In order to ensure utmost maneuverability and ease of operation, it has been found desirable to connect the control handle to the nozzle assembly by means of a swivel connection. Such a swivel connection allows fore-and-aft pivoting of the control handle with respect to the nozzle assembly about a first axis and rotational movement of the control handle about a second axis perpendicular to the first. The resulting swivel action allows the operator to maneuver the control handle to provide the best possible attack angle for turning and guiding the nozzle assembly during the vacuum cleaning operation.

Unfortunately, however, the freedom of movement provided by the swivel connection does have a drawback. Specifically, when the control handle is placed in the upright storage position over the nozzle assembly, it may be rotated to either side creating instability that may result in the toppling over of the nozzle assembly. This document describes a swivel lock mechanism that centers and locks the control handle in the most stable storage position thereby minimizing the potential for the toppling over of the nozzle assembly when the control handle is in the storage position.

SUMMARY OF THE INVENTION

Accordingly, a floor care apparatus is provided comprising a body including a nozzle assembly and a canister assembly, a suction generator carried on the body, a dirt collection vessel carried on the body and a control handle. A swivel assembly connects the control handle to the nozzle assembly. The swivel assembly includes a first member pivotally mounted to the nozzle assembly and a second member rotatably mounted with respect to the first member. The second member includes a receiver for receiving and holding the control handle. Additionally, the apparatus includes a swivel lock. The swivel lock includes (a) a slide carried on the first member and (b) a cooperating centering and locking projection carried on the second member. The slide includes a locking slot and the slide is displaceable between a use position and a control handle centering and locking position.

In one particularly useful embodiment the locking slot is substantially V-shaped. So is the guide projection. The V-shaped locking slot defines an included angle of between about 60 and about 120 degrees. Thus, the V-shaped locking slot may define an included angle of about 90 degrees. Similarly the V-shaped centering and locking projection defines an included angle of between about 60 and about 120 degrees. Thus, the V-shaped centering and locking projection may define an included angle of about 90 degrees.

Further describing the device, the slide includes a cam and the nozzle assembly includes an activation rib. The first member is pivotally connected to the nozzle assembly about a first pivot axis A and the control handle is pivoted about the first pivot axis A between the cleaning position and a storage position. The activation rib engages the cam when the control handle is pivoted into the storage position causing the slide to be displaced from the use position to the centering and locking position. There the V-shaped slot engages the V-shaped projection resulting in the centering of the control handle and the locking of the control handle in the centered storage position.

The first member further includes a guide and the slide includes a guide follower connecting the slide to the first member while allowing for free sliding movement along the first member. More specifically, the guide includes first and second ribs defining first and second opposed guide channels. The guide follower comprises first and second opposed flanges. The first flange is received for free sliding movement in the first channel while the second flange is received for free sliding movement in the second channel. The slide further includes a median section that extends through a gap between the first and second ribs.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
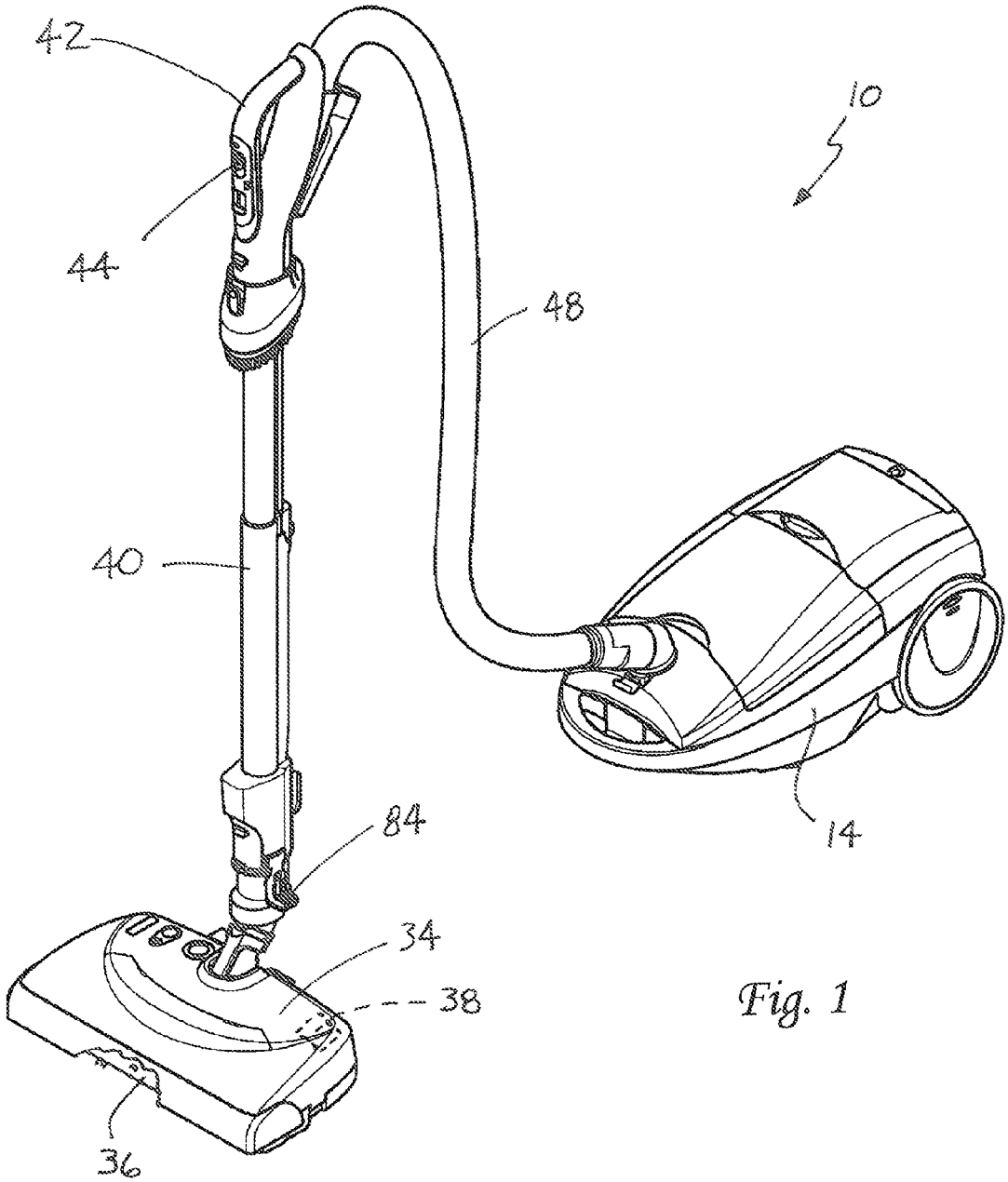
FIG. 1 is a perspective view of a canister vacuum cleaner.
Figure 2:
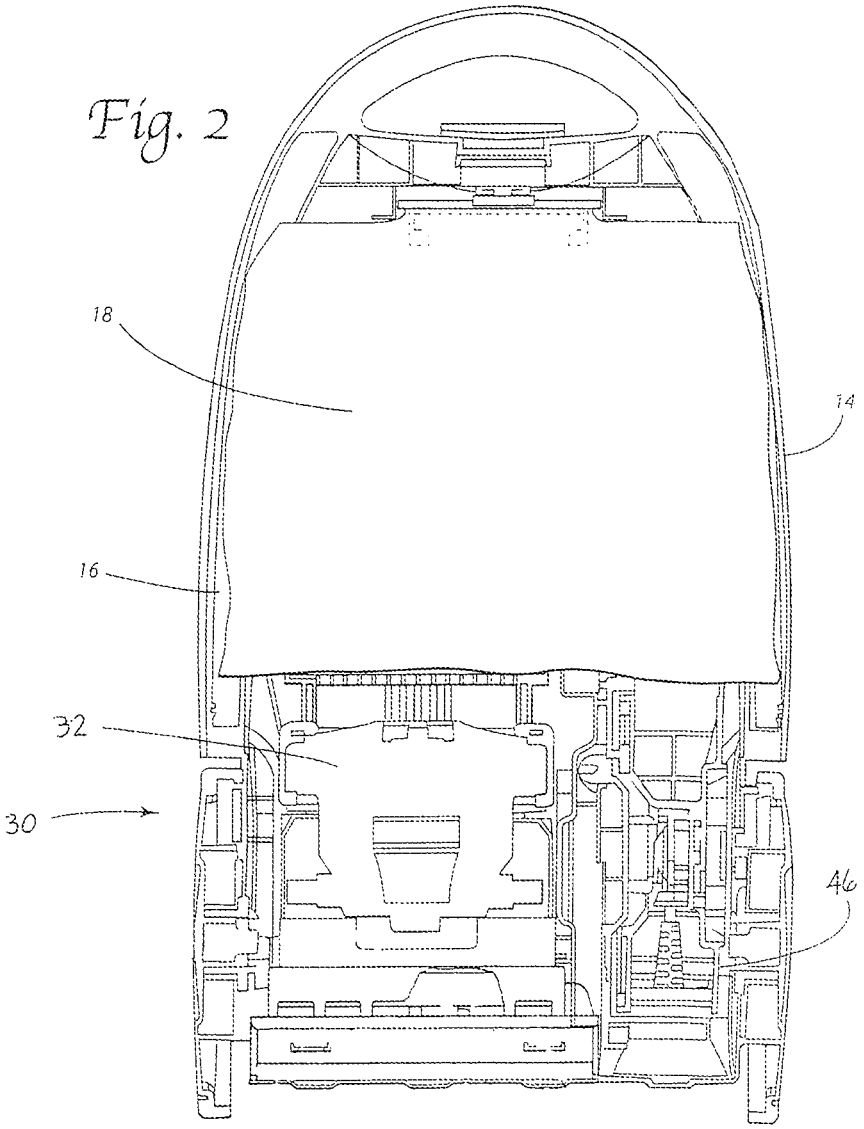
FIG. 2 is a top plan view illustrating the internal structure of the canister vacuum cleaner illustrated in FIG. 1.

Reference is now made to FIGS. 1-2 illustrating a canister vacuum cleaner 10 incorporating a swivel assembly 11 and a swivel lock 12. In the illustrated embodiment, the canister vacuum cleaner 10 includes a canister assembly 14 that includes a receiver 16 for receiving a dirt collection vessel 18 used to collect dirt and debris in a manner known in the art. As illustrated in FIG. 2 the dirt collection vessel 18 is a filter bag. It should be appreciated that the dirt collection vessel 18 may take other alternative forms, including, for example, that of a dirt cup. Such a dirt cup (not shown) may include a cylindrical side wall, a tangentially directed inlet, and an axially directed outlet. Further, a main or primary filter may be provided in the dirt cup over the outlet. The filter may be cylindrically shaped and concentrically received within the side wall of the dirt cup so as to provide an annular space there between. The tangentially directed inlet promotes cyclonic air-flow within this annular space to enhance cleaning efficiency.

Referring back to drawing FIGS. 1 and 2, the canister assembly 14 also includes a compartment 30 that receives a suction generator 32. A cord reel 46 takes up and pays out an electrical cord (not shown), which is connected to an electrical wall outlet to provide power to the vacuum cleaner. The vacuum cleaner 10 also includes a cleaning attachment illustrated in the form of a power head or nozzle assembly 34. The nozzle assembly 34 includes a rotary agitator 36 and a rotary agitator drive motor 38. The nozzle assembly 34 is connected to a control handle 42. The control handle 42 includes a wand 40 and a flexible hose 48. The control handle 42 also include an actuator 44 for turning the vacuum cleaner on and off. The flexible hose 48 includes a cuff at the proximal end thereof that connects the wand 40 to the dirt collection vessel 18 in the canister assembly 14. The canister assembly 14 is supported for movement across the floor by means of a caster wheel assembly (not shown) adjacent the front of the canister housing and a pair of wheels 54 carried at the rear of the canister assembly.

Figure 3:
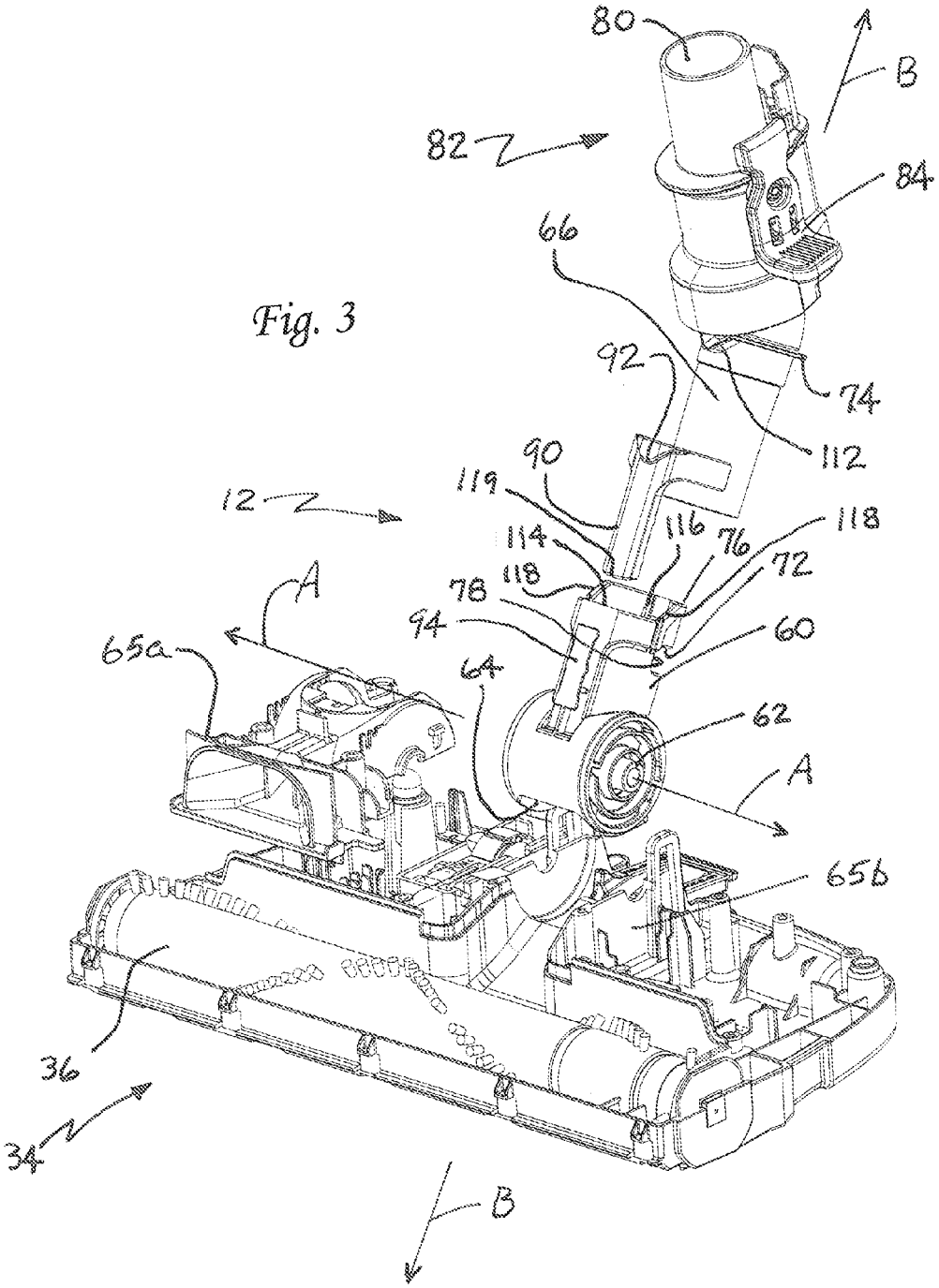
FIG. 3 is an exploded perspective view of the swivel assembly including the slide carried on the swivel assembly.
Figure 4:
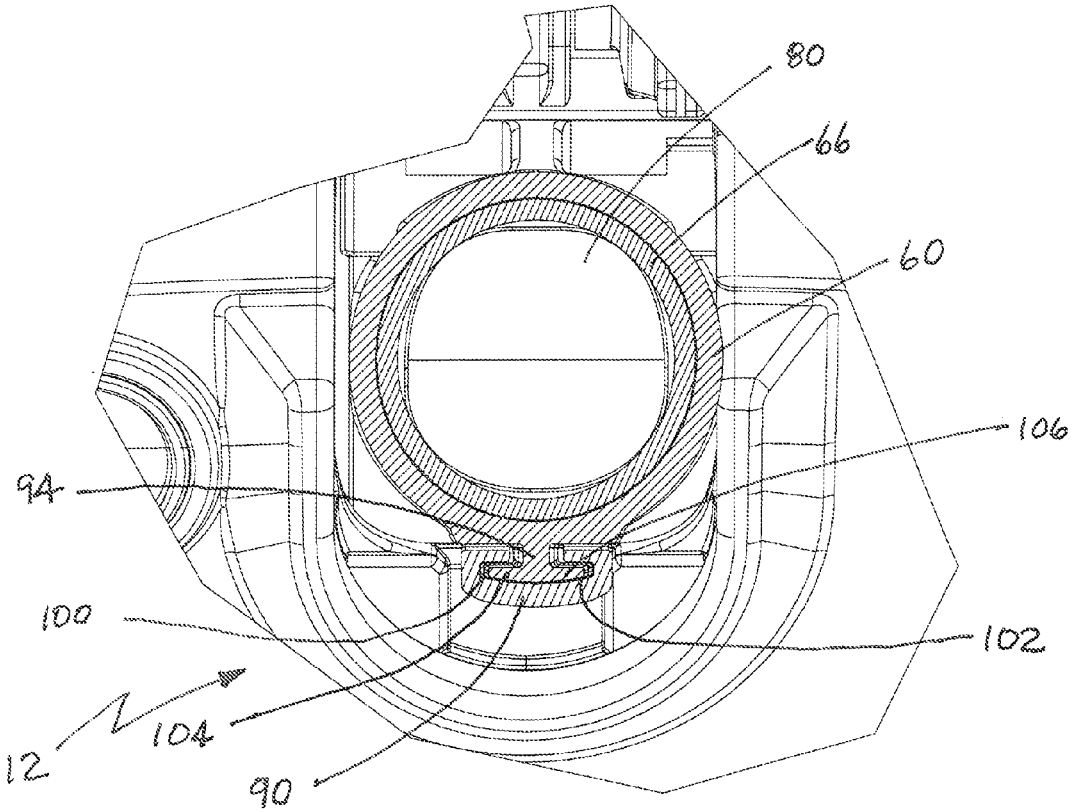
FIG. 4 is a detailed cross sectional view illustrating the connection of the slide to the first member of the swivel assembly.

Reference is now made to FIGS. 3 and 4 illustrating the swivel assembly 11 including the swivel lock 12. The swivel assembly 11 includes a first member 60 having a trunion mounting 62 at one end for pivotal mounting to the nozzle assembly 14. More specifically, the trunion mounting 62 is captured between the two chassis members 65*a*, 65*b* of the nozzle assembly. An air flow pathway 64 extends through the first member 60 including the trunion mounting 62. The swivel assembly 11 also includes a second member 66 having a first end 68 received in the first member 60. When the second member 66 is properly received in the first member 60, a stop 70 on the second member is received in a slot 72 on the first member 60. In addition, a ring flange 74 on the second member 66 is juxtaposed to a cooperating arc flange 76 on the first member. When properly connected, the second member 66 is rotatably mounted with respect to the first member 60. In the illustrated embodiment the second member 66 will rotate through an arc of approximately 180 degrees with respect to the first member 60 until the stop 70 engages either of the ends 78 of the slot 72.

The second member 66 includes an air flow conduit 80 that is aligned and in communication with the airflow pathway 64 of the first member 60. A receiver 82 is provided at the second end of the second member. The receiver 82 receives and holds the wand 40 of the control handle 42. A spring loaded lever 84 includes a detent (not shown) that passes through an opening in the second member 66 and engages in a cooperating opening in the wand 40 to secure the wand in the receiver 82 of the second member 66.

In use, the control handle 42 pivots fore and aft with respect to the nozzle assembly 34 about the pivot axis A defined by the trunion mounting 62. In addition, the control handle 42 may be pivoted through an arc of approximately 90 degrees to the left or right of dead center by the rotational mounting of the second member 66 in the first member 60 of the first swivel assembly 11 (note axis B in FIG. 3). As should be appreciated, the rotational axis B of the second member 66 is substantially perpendicular to the pivot axis A of the trunion mounting 62. This geometry provides a complete swivel connection between the control handle 42 and the nozzle assembly 34 that allows the operator to easily maneuver the nozzle assembly during substantially any cleaning operation.

As further illustrated in FIGS. 3 and 4, the apparatus 10 also includes a swivel lock 12. The swivel lock 12 includes a slide 90 carried on the first member 60. The slide 90 includes a locking slot 92. The locking slot 92 is substantially V-shaped and defines an included angle between about 60 and about 120 degrees including, for example, 90 degrees. As will be described in greater detail below, the slide 90 is displaceable between a use position illustrated in FIGS. 5*a* and 5*b* and a control handle centering and locking position illustrated in FIGS. 6*a* and 6*b*.

More specifically, the first member 60 includes a guide generally designated by reference numeral 94. As best illustrated in FIG. 4, the guide 94 is substantially T-shaped in cross section so as to define first and second opposed guide channels 100, 102. The slide 90 includes a guide follower comprising first and second opposed flanges 104, 106. When the slide 90 is properly positioned on the first member 60, the first flange 104 is received for free sliding movement in the first channel 100 and the second flange 106 is received for free sliding movement in the second channel 102.

The swivel lock 12 also includes a cooperating centering and locking projection 112 carried on the second member 66. The centering and locking projection 112 is substantially V-shaped and defines an included angle of between 60 and 120 degrees including, for example, 90 degrees. As illustrated, the centering and locking projection 112 is provided on the second member 66 on the first member side of the ring flange 74. When the second member 66 is properly seated in the first member 60, the centering and locking projection 112 projects into a clearance cutout 114 provided in the collar 116 of the first member 60. The ends 118 of the clearance cutout 114 like the ends 78 of the slot 72 allow for rotational movement of the second member 66 relative to the first member 60 of approximately 180 degrees.

Figure 5A:
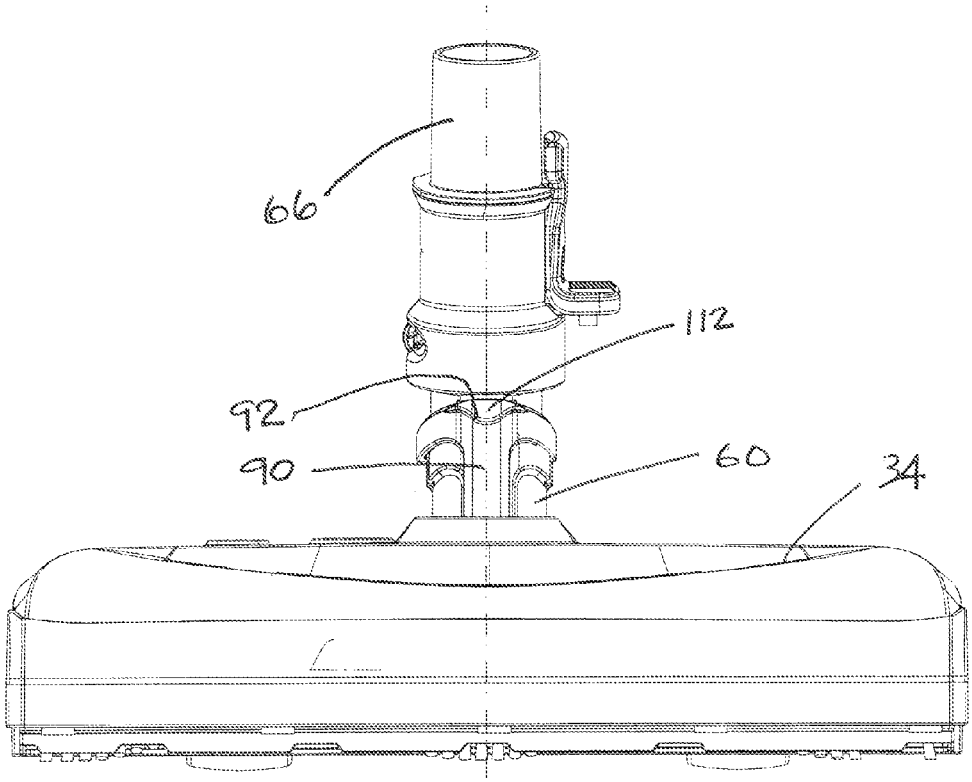
FIGS. 5*a* and 5*b* are respective detailed front elevational and cross sectional views illustrating the slide in the storage position.
Figure 5B:
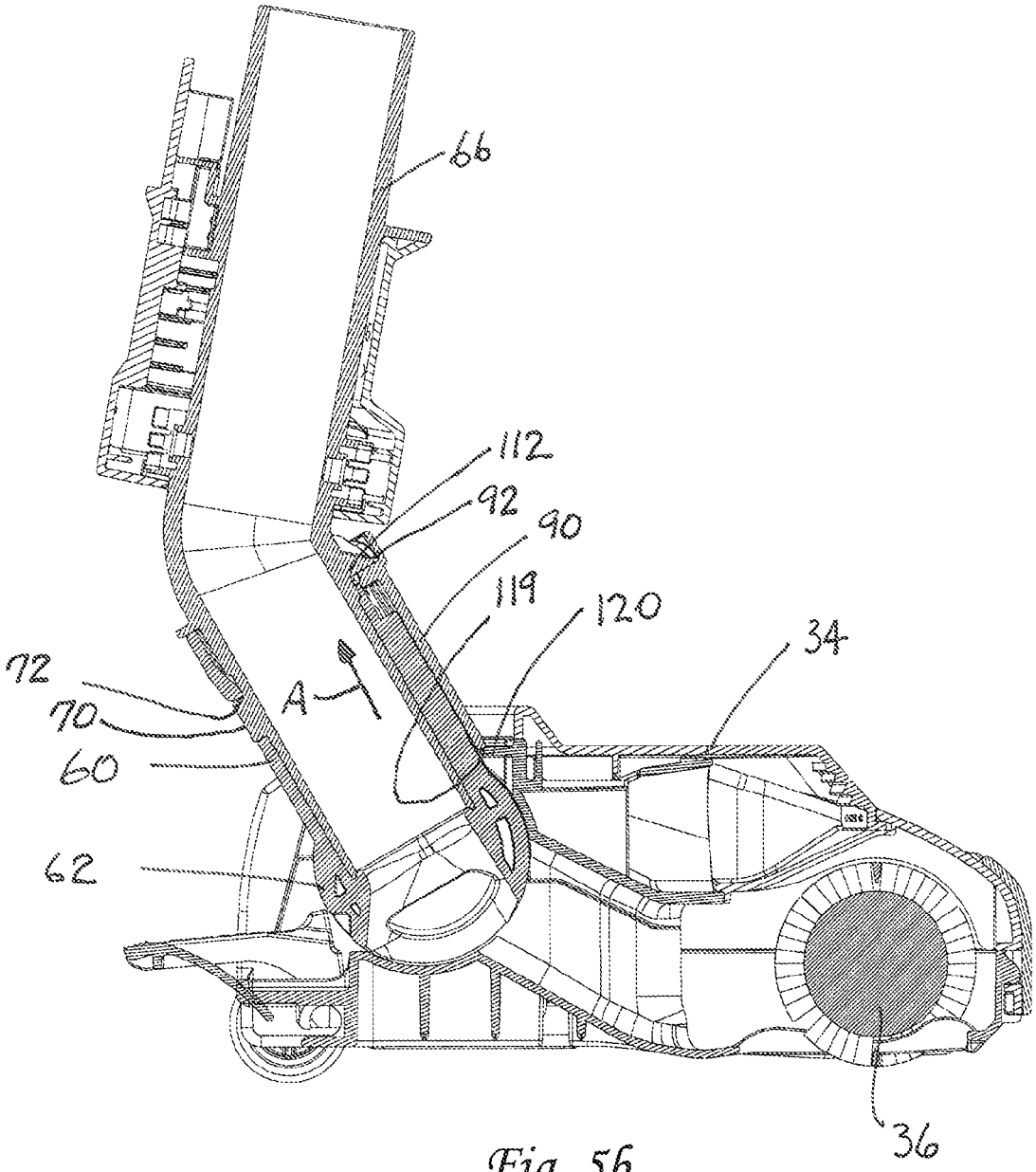
Figure 6A:
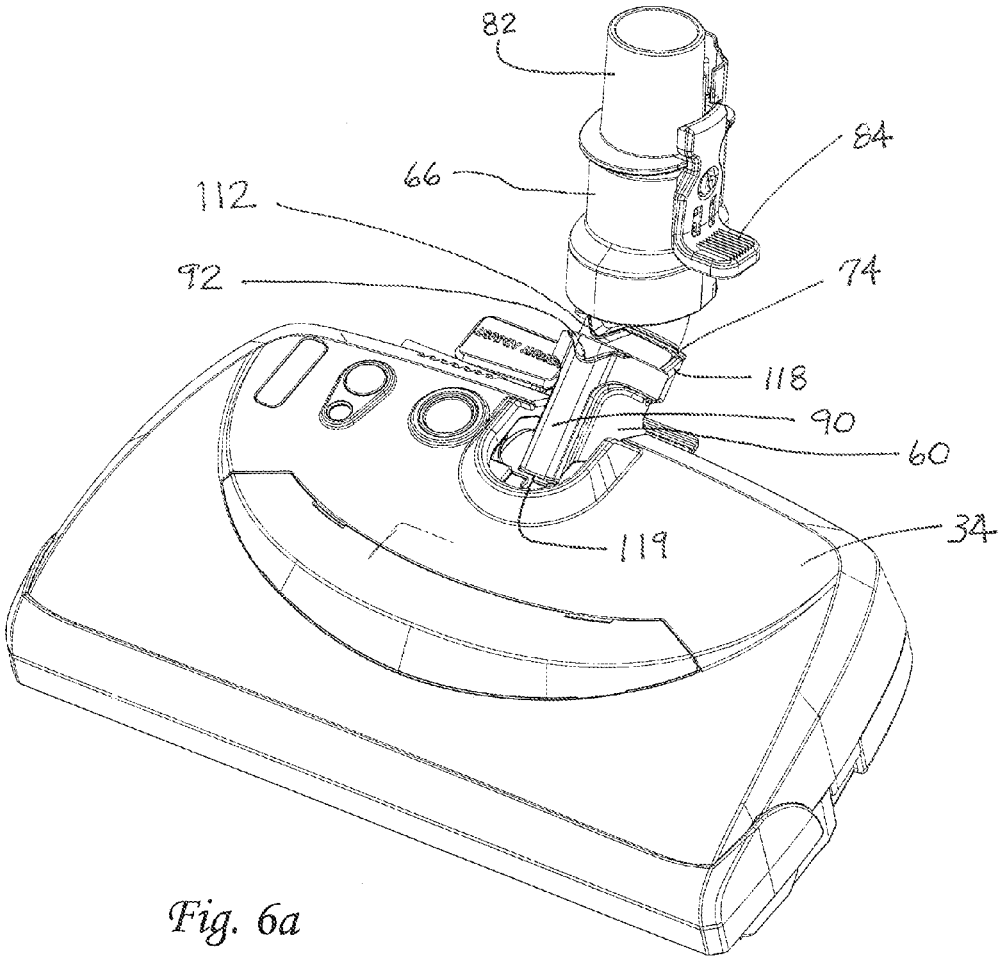
FIGS. 6*a* and 6*b* are respective detailed perspective and cross sectional views illustrating the slide in the use position.
Figure 6B:
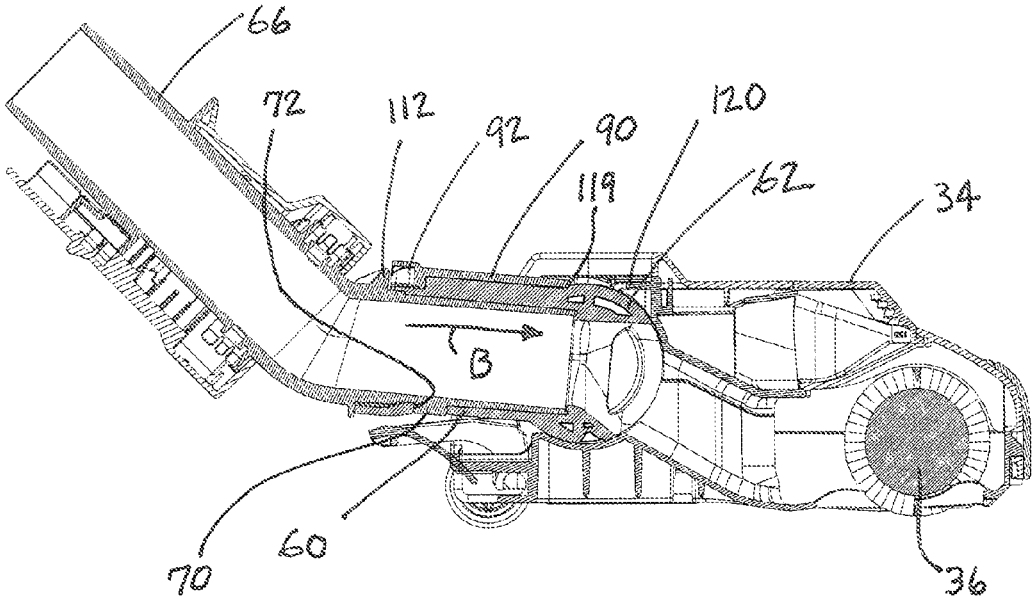

As illustrated in FIGS. 5*a* and 5*b*, when the control handle 42 is pivoted into an upright, storage position about the pivot axis A of the trunion mounting 62, a cam 119 on the end of the substantially T-shaped slide 90 engages an activation rib 120 on the nozzle assembly 32. This engagement forces the slide 90 to move from a use position adjacent the nozzle assembly 32 toward the second member 66 into a control handle centering and locking position (see action arrow A in FIG. 5*b*). Thus, as the control handle 42 is pivoted toward the upright storage position, the V-shaped slot 92 on the slide 90 engages the V-shaped centering and locking projection 112 on the second member 66. As the centering and locking projection 112 nests in the V-shaped slot 92 the control handle is first centered and then locked into a central storage position overlying the nozzle assembly 32 so as to provide utmost upright stability and prevent inadvertent tipping of the nozzle assembly. See particularly FIGS. 5*a* and 5*b* showing the slide in the control handle centering and locking position and the projection 112 nested in the slot 92.

When the operator inclines the control handle 42 into a use position (see FIGS. 6*a* and 6*b*), the cam 119 becomes disengaged from the activation rib 120 on the nozzle assembly 32. With the cam 119 thus disengaged, the slide 90 is released from the control handle centering and locking position and free to be displaced to the use position. As the operator twists or rotates the control handle 42 about the rotational axis of the second member 66 with the first member 60 to guide the nozzle assembly 32, the camming surface of the V-shaped centering and locking projection 112 engages the camming surface of the cooperating slot 92 and the slide 90 is pushed freely down into the use position where it does not interfere with the rotational motion of the control handle 42 (see action arrow B in FIG. 6*b*). Accordingly, full swiveling movement of the swivel assembly 11 is restored during use of the vacuum cleaner. After completing the vacuum cleaning application, the control handle 42 may again be returned to the upright storage position (note FIGS. 1, 5*a* and 5*b*). At that time, the cam 119 on the slide 90 is once again moved into contact with the activation rib 120 on the nozzle assembly 32. This forces the slide 90 to move from the use position back to the control handle centering and locking position where the centering and locking projection 112 is again forced into full nesting position within the slot 92 so that the control handle 42 is centered and locked in a stable storage position.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor care apparatus, comprising:

a body including a nozzle assembly and a canister assembly;

a suction generator carried on said body;

a dirt collection vessel carried on said body;

a control handle;

a swivel assembly connecting said control handle to said nozzle assembly, said swivel assembly including a first member pivotally mounted to said nozzle assembly and a second member rotatably mounted with respect to said first member, said second member including a receiver receiving and holding said control handle; and a swivel lock, said swivel lock including: (a) a slide carried on said first member, said slide including a locking slot and said slide being displaceable with respect to said first member between a use position and a control handle centering and locking position and (b) a cooperating centering and locking projection carried on said second member.

2. The apparatus of claim 1, wherein said locking slot is substantially V-shaped.

3. The apparatus of claim 2, wherein said centering and locking projection is substantially V-shaped.

4. The apparatus of claim 3, wherein said V-shaped locking slot defines an included angle of between about 60 and about 120 degrees.

5. The apparatus of claim 3, wherein said V-shaped locking slot defines an included angle of about 90 degrees.

6. The apparatus of claim 3, wherein said V-shaped centering and locking projection defines an included angle of between about 60 and about 120 degrees.

7. The apparatus of claim 3, wherein said V-shaped centering and locking projection defines an included angle of about 90 degrees.

8. The apparatus of claim 1, wherein said swivel lock is springless.

9. The apparatus of claim 1, wherein said control handle includes a wand and a flexible hose.

10. A floor care apparatus, comprising:

a body including a nozzle assembly and a canister assembly;

a suction generator carried on said body;

a dirt collection vessel carried on said body;

a control handle;

a swivel assembly connecting said control handle to said nozzle assembly, said swivel assembly including a first member pivotally mounted to said nozzle assembly and a second member rotatably mounted with respect to said first member, said second member including a receiver receiving and holding said control handle; and a swivel lock, said swivel lock including: (a) a slide carried on said first member, said slide including a cam and a substantially v-shaped locking slot and said slide being displaceable between a use position and a control handle centering and locking position and (b) a cooperating, substantially v-shaped centering and locking projection carried on said second member.

11. The apparatus of claim 10, further including an activation rib on said nozzle assembly.

12. The apparatus of claim 11, wherein said first member is pivotally connected to said nozzle assembly about a first pivot axis A and said control handle is pivoted about said first pivot axis A between a cleaning position and a storage position.

13. The apparatus of claim 12, wherein said activation rib engages said cam when said control handle is pivoted into said storage position causing said slide to be displaced from said use position to said centering and locking position where said V-shaped slot engages said V-shaped projection resulting in centering of said control handle and locking of said control handle in said centered storage position.

14. The apparatus of claim 12, wherein said activation rib is disengaged from said cam when said control handle is pivoted into said cleaning position and rotation of said control handle and said second member causes said centering and locking projection to engage said slot and displace said slide from said control handle centering and locking position into said use position allowing full swivel movement of said control handle for freely steering said apparatus.

15. The apparatus of claim 10, wherein said first member includes a guide and said slide includes a guide follower connecting said slide to said first member while allowing for free sliding movement along said first member.

16. The apparatus of claim 15, wherein said guide is substantially T-shaped in cross section and defines first and second opposed guide channels.

17. The apparatus of claim 16, wherein said guide follower comprises first and second opposed flanges, said first flange received for free sliding movement in said first channel and said second flange received for free sliding movement in said second channel.

* * * * *